US006385847B1

(12) United States Patent
Larson et al.

(10) Patent No.: US 6,385,847 B1
(45) Date of Patent: May 14, 2002

(54) SEAT FACED ENGINE VALVES AND METHOD OF MAKING SEAT FACED ENGINE VALVES

(75) Inventors: Jay M. Larson, Marshall, MI (US); David F. Berlinger, Clear Lake; James R. Spencer, Kanawha, both of IA (US); Xin Nie, Shanghai (CN)

(73) Assignee: Eaton Corporation, Cleveland, OH (US)

( * ) Notice: Subject to any disclaimer, the term of this patent is extended or adjusted under 35 U.S.C. 154(b) by 0 days.

(21) Appl. No.: 09/661,335

(22) Filed: Sep. 13, 2000

(51) Int. Cl.[7] ..... B23P 15/00

(52) U.S. Cl. ..... 29/888.451; 29/888.4; 29/888.43; 29/888.46

(58) Field of Search ..... 29/888.4, 888.43, 29/888.451, 888.46; 123/188.2, 188.3, 188.8

(56) References Cited

U.S. PATENT DOCUMENTS

| | | | | |
|---|---|---|---|---|
| 4,075,999 A | | 2/1978 | Danis | 123/191 A |
| 4,104,505 A | | 8/1978 | Rayment et al. | 219/76.16 |
| 4,741,080 A | | 5/1988 | Larson et al. | 29/156.7 R |
| 4,943,698 A | | 7/1990 | Mengel | 219/121.47 |
| 5,125,962 A | | 6/1992 | Krentscher | 75/247 |
| 5,315,792 A | | 5/1994 | Schweizer et al. | 51/317 |
| 5,649,358 A | * | 7/1997 | Adachi et al. | 29/888.4 |
| 5,742,020 A | * | 4/1998 | Adachi et al. | 29/888.46 |
| 5,778,534 A | * | 7/1998 | Kim | 29/888.451 |
| 5,809,644 A | * | 9/1998 | Adachi | 29/888.43 |
| 5,943,990 A | * | 8/1999 | Mori et al. | 123/90.51 |
| 5,960,760 A | * | 10/1999 | Wang et al. | 123/188.3 |
| 5,975,039 A | * | 11/1999 | Oshige | 123/188.8 |
| 6,161,285 A | * | 12/2000 | Eberhardt et al. | 29/888.451 |
| 6,295,731 B1 | * | 10/2001 | Yamakawa et al. | 29/888.4 |

FOREIGN PATENT DOCUMENTS

| | | | |
|---|---|---|---|
| EP | 0 801 214 A1 | 10/1997 | F01L/3/04 |

* cited by examiner

*Primary Examiner*—I Cuda-Rosenbaum
(74) *Attorney, Agent, or Firm*—Daniel S. Kalka; L. J. Kasper

(57) ABSTRACT

An improved process 30 for making an engine poppet valve 10 provides an unfinished poppet valve 10 with an initial diameter ($d_1$) of a valve head 22 and an initial thickness ($t_1$) of an interface 56 between a seat facing groove 54 and a combustion face 18 of the valve 50 prior to seat facing the valve 50 to prevent burn-through during the welding process 38. Coining 40 the valve head 22 after seat facing 38 decreases the initial thickness ($t_1$) of the interface 56 to a selected thickness ($t_2$) and increases the initial diameter ($d_1$) to a final or desired diameter ($d_2$) of the valve head 22. The method of the present invention eliminates any need for removing excess material and allows for hot forming the seat facing material 58 to reduce machining steps.

7 Claims, 4 Drawing Sheets

SEAT FACED ENGINE VALVES AND METHOD OF MAKING SEAT FACED ENGINE VALVES

CROSS-REFERENCE TO RELATED APPLICATIONS

Not Applicable

STATEMENT REGARDING FEDERALLY SPONSORED RESEARCH OR DEVELOPMENT

Not Applicable

MICROFICHE APPENDIX

Not Applicable

BACKGROUND OF THE INVENTION

1. Field of the Invention

The present invention relates generally to poppet valves for internal combustion engines, and more particularly to a method of making a seat faced engine poppet valve.

2. Description of the Related Art

It is well known in the industry that engine poppet valves, particularly exhaust valves for heavy and moderate duty applications like those found in diesel and leaded fuel engine applications, operate at relatively high temperatures and in somewhat corrosive environments. In the manufacture of engine poppet valves, it is a common practice to face the valve with a corrosion, wear, abrasion, and heat resistant alloy to protect the valve face and enhance the useful life of the valve. The term "facing", or "seat facing" as used herein is intended to encompass the term "hard facing" which is also used in the industry. These terms refer to providing the valve face with a corrosion, wear, abrasion, and/or heat resistant alloy to attain the necessary wear and corrosion resistance required for the given application. There is continued interest in seat facing poppet valves, both intake and exhaust valves, for high performance engines as well as smaller engines for use in motorcycles, for example.

Typically, the facing material has been a cobalt based alloy such as a Stellite® alloy (Stellite is a registered trademark of Deloro Stellite Company, Inc.), or a nickel based alloy like Eatonite®, (Eatonite is a registered trademark of Eaton Corporation). More recently, Eatonite® 6, an iron based alloy, has been used and is rapidly replacing cobalt based alloys. There are other alloys for seat facing, including but not limited to, nickel-chromium, or nickel-chromium-cobalt base alloys, or various alloys known in the industry. The facing is usually applied to the valve seating surface by various high temperature techniques, like welding. The seat facing is preferably applied in a manner that can control metallurgy and microstructure. Typical heat sources for welding include, but are not limited to, oxy-acetylene torch, tungsten inert gas arc (TIG), or plasma arc (transferred or non-transferred), or the like.

The plasma transferred arc process offers several advantages over flame welding processes including but not limited to: precision controllable heat source and lower energy consumption which can provide finer microstructure and narrower heat affected zones (HAZ); versatility for powders and different raw materials; higher volume production capability; and minimum raw material waste. However, the current plasma transferred (PTA) process operates at such a high temperature that in some valve applications the torch burns through the valve from the seat facing groove to the valve combustion face on the valve head. An obvious solution to this problem is to simply add additional stock material to the combustion face to act as a heat sink. However, that option adds to the cost of manufacturing due to the extra machining required to remove the material afterwards as well as the cost of the material itself, as a waste material.

Consequently, there still exists a need for an improved process of seat facing an engine poppet valve which addresses the aforementioned problem of "burn-through" as well as others, and particularly this problem with seat facing small poppet valves intended for use in high performance engines like those employed in small internal combustion motors such as motorcycle engines. Preferably, the method would avoid PTA burn-through of the valve head and reduce or even eliminate any unnecessary machining operations for removing excess material.

BRIEF SUMMARY OF THE INVENTION

Accordingly, an object of the present invention is to provide an improved method for making an engine poppet valve that prevents burn-through during the seat facing step.

Another object of the present invention is to provide an improved method for making a small engine poppet valve.

Still another object of the present invention is to provide an improved process for making an engine poppet valve that reduces the number of machining steps.

Still another object of the present invention is to provide an improved method for seat facing engine poppet valves using a plasma transferred arc welding process.

A further object of the present invention is to provide an improved method for making engine poppet valves that is cost effective and reduces waste material.

In the method for making an engine poppet valve in accordance with the present invention, the method comprises the steps of forging an unfinished poppet valve from stock material to provide a valve head having an initial head diameter; forming a seat facing groove in the valve head of the unfinished poppet valve; providing an initial thickness of an interface of the seat facing groove and a combustion face of the unfinished poppet valve; depositing seat facing material in the seat facing groove; and reheating the valve head and coining a desired head diameter while hot forming the seat facing material into the interface to decrease the interface from the initial thickness to a final thickness, and increase the valve head diameter from the initial diameter to the desired diameter for finishing the engine poppet valve.

In another aspect, the present invention is directed to the engine poppet valve manufactured in accordance with the process of the present invention.

The various features of novelty, which characterize the invention, are pointed out with particularity in the claims annexed to and forming a part of this disclosure. For a better understanding of the invention, its operating advantages and specific objects attained by its uses, reference is made to the accompanying drawings and descriptive matter in which a preferred embodiment of the invention is described and illustrated.

DETAILED DESCRIPTION OF THE INVENTION

Figure 1:
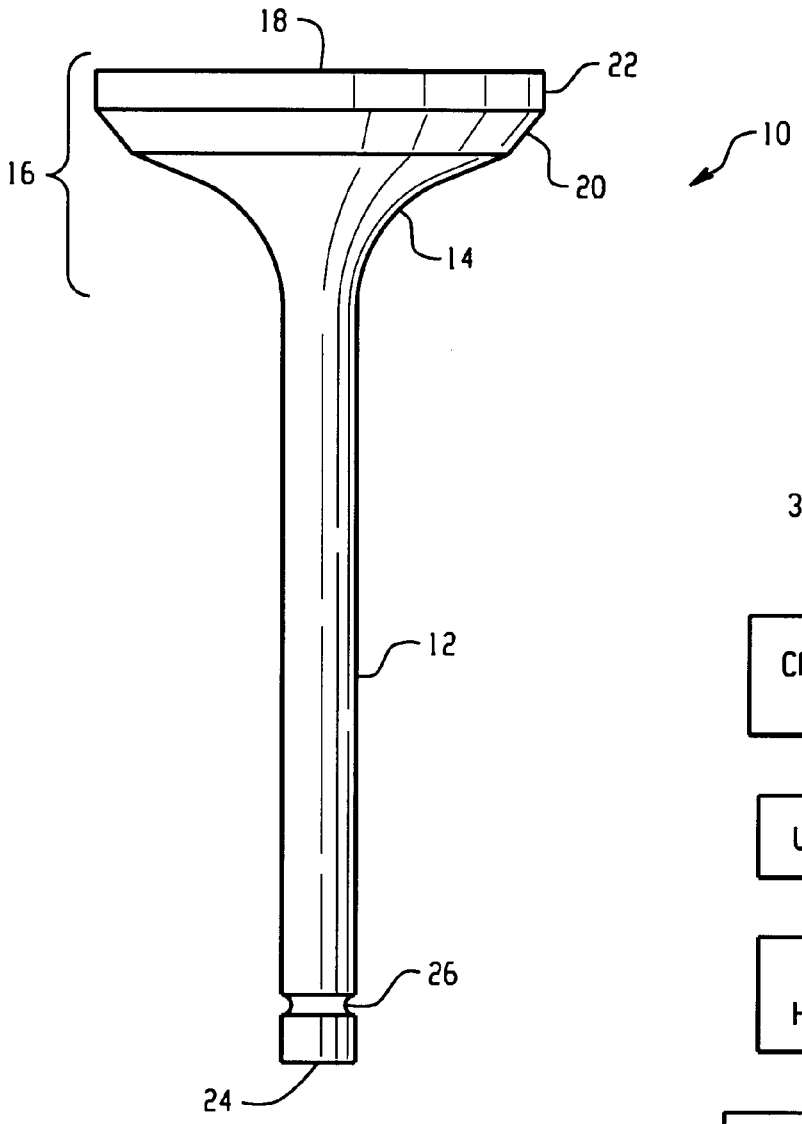
FIG. 1 is a side view of a typical engine poppet valve.

Referring first to FIG. 1, there is shown a side view of an engine poppet valve, generally designated 10. The figures are not intended to limit the present invention, and like numerals in the figures designate like or similar features. Valve 10 includes a stem 12, a fillet 14, and a valve head portion generally designated 16. The valve head portion 16 includes a combustion face 18 that faces inwardly into an engine combustion chamber (not shown). A valve seat face 20 is the peripheral surface that engages the engine block or a valve seat insert (not shown). The valve head portion 16 further includes a valve head 22 with a predetermined diameter which depends upon the given application. The fillet 14 is a transition region which tapers concavely inwardly connecting the valve head 22 to the stem 12 which extends to a tip 24. A keeper groove 26 is often provided to accommodate a retainer for a valve spring. An engine poppet valve 10 can be solid, hollow, or partially solid/hollow as is known in this art. The structure and function of engine poppet valves is well known in the industry.

The process of the present invention is applicable to any solid engine poppet valve or one having a solid head portion and a hollow stem. For example, the method of the present invention may be used to forge a solid head portion 16 which is then welded to a hollow stem 12. The method of the present invention can use any metallic valve material that is suitable for a particular application and which is forgeable. Suitable materials include, but are not limited to, austenitic steels of the Society of Automotive Engineers (S.A.E.) engine valve (EV) series like 21-2N; 21-4N; 23-8N; or like compositions used for poppet valves. The process of the present invention is also applicable to solution heat treatable steels of the S.A.E. high temperature engine valve (HEV) series, such as wrought nickel base alloys sold under a variety of brand names like Inconel, a registered trademark of Inco Alloys International Inc., or Nimonic, a registered trademark of Henry Wiggin & Company, Ltd.

Figure 2:
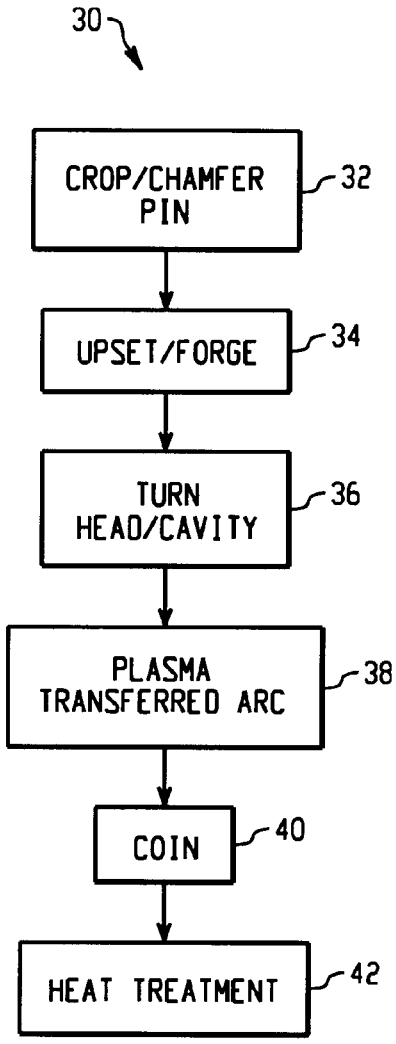
FIG. 2 is a block diagram illustrating the steps of the method of the present invention.

Referring to FIG. 2, there is shown a block diagram of the process steps generally designated 30 in accordance with the present invention. The steps in the process include a crop/chamfer pin step 32, the upset/forge step 34, the turn head/cavity step 36, the plasma transferred arc (PTA) step 38, the coin step 40, and the optional heat treatment step 42. Each of these steps will be described in greater detail with reference to FIGS. 3–7. The optional heat treatment step 42, while depicted as being the last step in the process 30, can occur before or after any step or steps in the process if desired. Similarly, a variety of heat treatment processes known in the art may be employed in any sequence.

Figure 3:
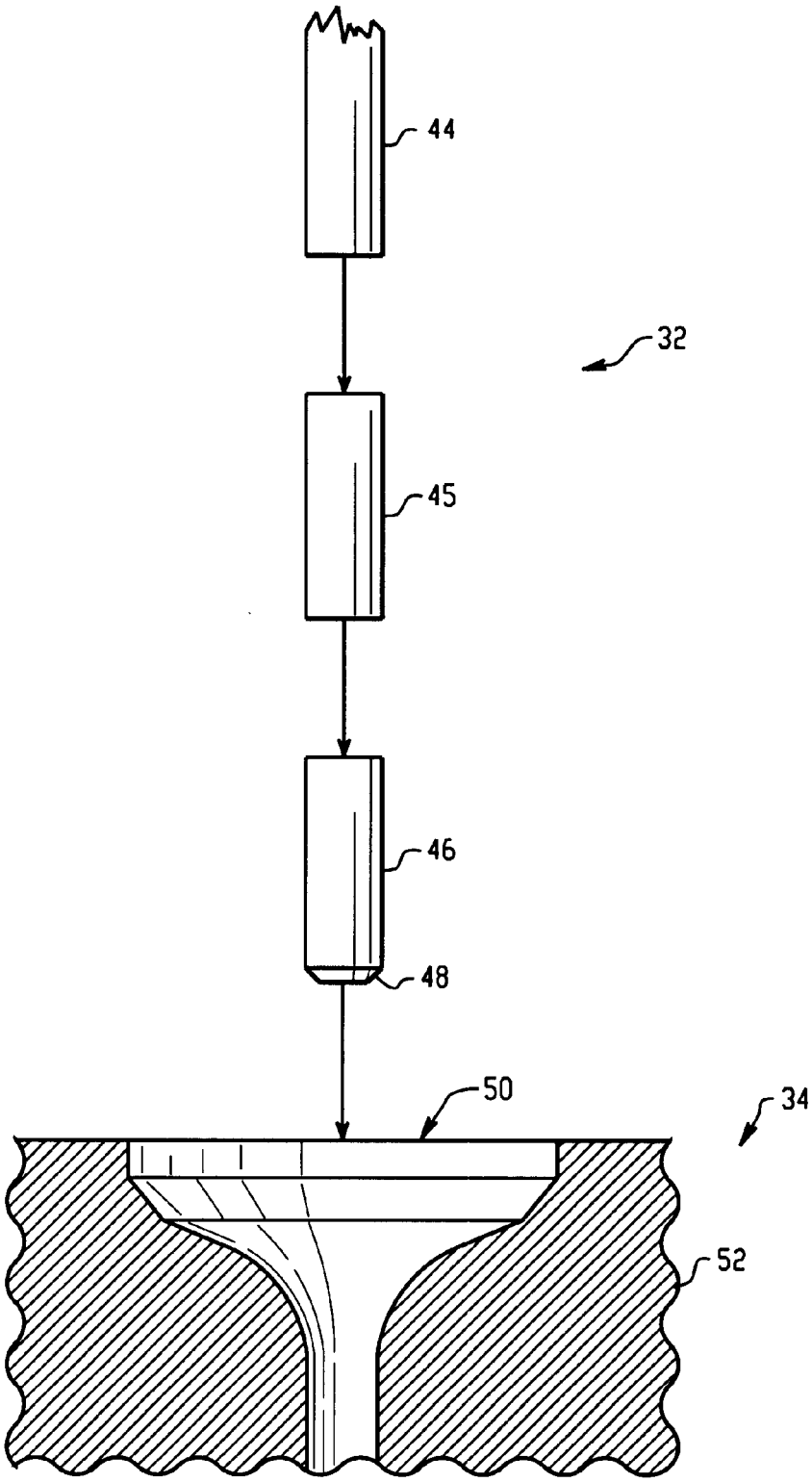
FIG. 3 is a stepwise diagram of a stock material being manufactured into an engine poppet valve according to steps 32 and 34 of the method of the present invention.

Referring now to FIG. 3, there is shown the crop/chamfer pin step 32. In step 32, stock material, for example a wrought bar 44 of a metallic valve material, like 21-4N, of a given diameter is first cut to a workable length to form a rod 45. Rod 45, which has an initial approximate three meter length, is then cut or sheared to form a pin 46 which has an approximate 0.25 to 0.4 meter length. One end 48 of the pin 46 is then chamfered to an approximate angle of 45°, over a length of approximately 1 to 2 mm. It should be understood that these dimensions are being provided for illustrative purposes only, and are not intended to limit the present invention thereto.

The next step in process 30 is the upset/forge step 34. The pin 46 is upset and forged into an unfinished valve 50 shown in FIG. 3 within a forging die 52. The chamfered end 48 facilitates positioning the pin 46 and keeping it straight during the upset and forge process steps 34. The upset/forge step 34 as depicted in FIG. 2 particularly relates to a pin which is electrically upset and forged. The present invention is also applicable to modifications of the individual steps depicted in FIG. 2. For example, in the upset/forge step of an extrude and restrike process (a valve making process known in the art), a slug, which has a much larger diameter than the valve stem diameter as opposed to the pin which is slightly larger than the final stem diameter of the valve, is heated and the stem is extruded (forced into a die slightly larger than the final valve stem diameter) such that roughly half the slug is formed into the valve stem. The "onion" portion is the nonextruded part of the slug. The term "onion" is a term of art referring to the enlarged, unfinished portion of the valve head. The restrike step is similar to the forging step in the upset/forge step 34 in forming the valve almost to a finished condition. It should be understood that the present invention is applicable to a wide variety of valve making processes and the individual steps described herein may be modified without departing from the principles of the present invention in seat facing an engine poppet valve.

The upset pin 46 is forged at a predetermined temperature in die 52 that is constructed to form partially the head portion 16 of the unfinished valve 50. The stem 12 may be either formed within die 52 or extruded with a process like that described in U.S. Pat. No. 4,741,080, assigned to the assignee of the present invention, and hereby incorporated by reference.

Figure 4:
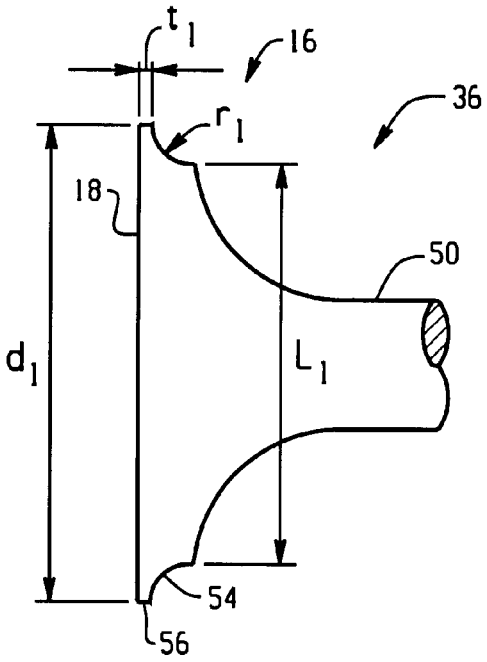
FIGS. 4–7 are side views of a head portion of an engine poppet valve being manufactured according to the method of the present invention.
Figure 5:
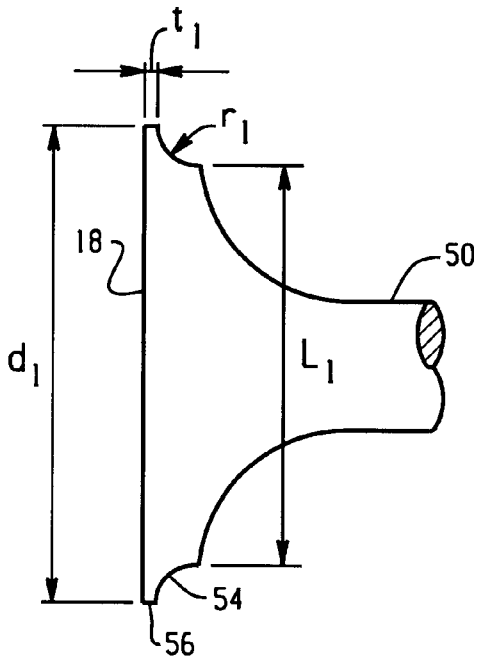

Referring next to FIGS. 4–7, the turn head/cavity step 36 includes turning the head portion 16 of the unfinished valve 50 with a lathe or a device such as a milling cutter (not shown) to provide a selected initial diameter ($d_1$) of the valve head, approximately 23.5 mm, to bring it to substantially its final form. The turning step 36 also removes any imperfections resulting from the upset and forge step 34 of the process 30 of the present invention. The turn head/cavity step 36 includes the step of cutting or "turning" a seat facing cavity or groove 54, as seen in FIGS. 4–5, into the valve head portion 16 with a lathe. The seat facing cavity 54 may also be forged. If the seat facing cavity 54 is forged, then it is preferable to remove an oxide layer therein prior to PTA seat facing to avoid excess porosity. The seat facing groove 54 has a radius of curvature ($r_1$) of approximately 2.5 mm. A selected initial thickness ($t_1$) of a seat interface 56 between seat facing groove 54 and the combustion face 18 of the unfinished poppet valve 50 is provided and is approximately 1.5 mm. An inner diameter ($L_1$) between the lower edges of seat facing groove 54 ranges approximately between 19.36 mm to 20.36 mm. FIG. 4 shows the unfinished poppet valve 50 with inner diameter ($L_1$) of approximately 19.36 mm, and FIG. 5 is a similar view where the diameter ($L_1$) is approximately 20.36 mm.

Next is the plasma transferred arc step 38 which includes a step of depositing or placing a seat facing alloy 58 (see FIG. 6) in the seat facing groove 54 by way of any number of well known techniques including, but not limited to, heat fusing molten material in the seat facing groove 54, welding a preformed ring within the groove 54, or even laser cladding seat facing material therein. The preferred technique employed in the present invention is plasma transferred arc (PTA) welding with Eatonite® 6 material. A suitable plasma transferred arc welding process is described in U.S. Pat. No. 4,104,505, which is assigned to the assignee of the present invention, and hereby incorporated by reference. As mentioned previously, a wide variety of seat facing or hard facing alloys may be used with the present invention, including but not limited to, those described in U.S. Pat. Nos. 4,075,999 and 4,943,698, both patents being assigned to the assignee of the present invention, and hereby incorporated by reference.

Figure 7:
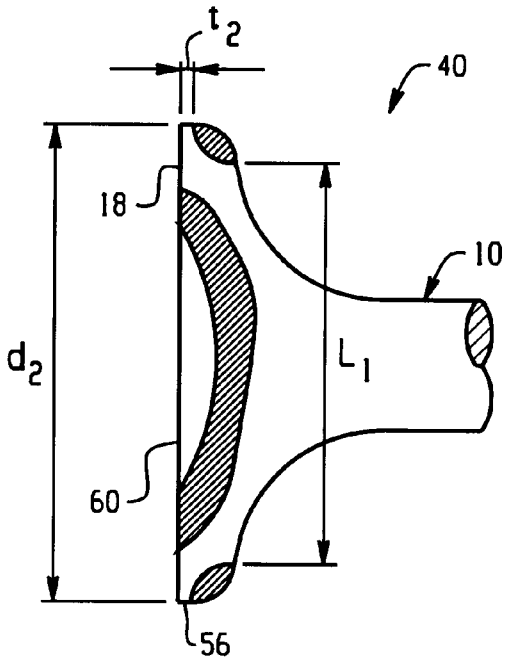
Figure 8:
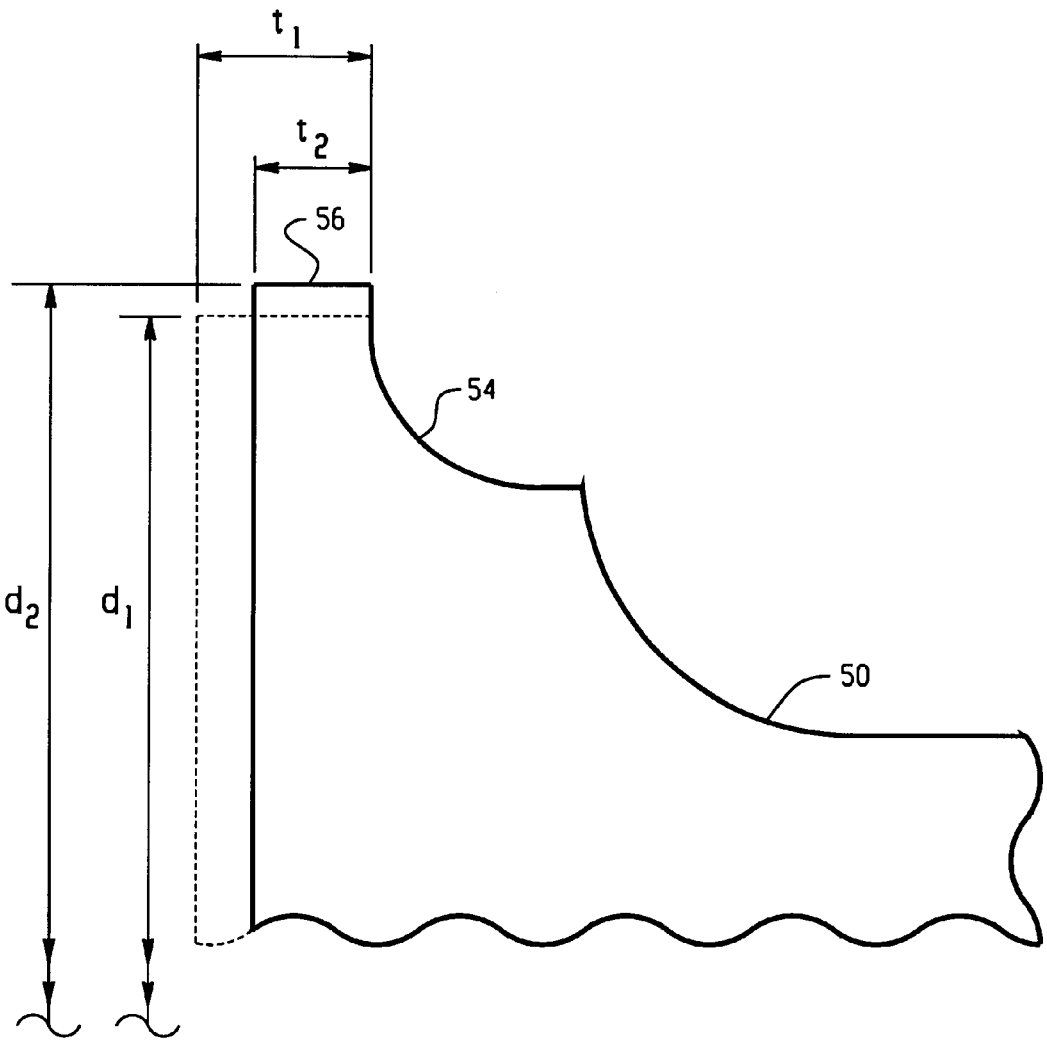
FIG. 8 is a enlarged side view of a portion of a valve head illustrating with a dashed line the change in initial diameter ($d_1$) to final diameter ($d_2$) and the change in an initial thickness ($t_1$) of a seat interface to a final thickness ($t_2$).

After the seat facing material 58 is deposited, the unfinished valve 50 is re-heated and coined in the coin step 40 of process 30 such that the head diameter ($d_2$) increases a selected amount to a final or desired valve head diameter 22 of about 25.3 mm from the original diameter ($d_1$) of about 23.5 mm as seen in FIGS. 7 and 8 . The term "coin step" as employed herein is intended to include the terms "hot forming" or "forging" during the coining step. The coin step increases the initial diameter ($d_1$) of the valve head 22 to the selected diameter ($d_2$) of the valve head 22 while at the same time the selected valve seat interface 56 thickness ($t_1$) decreases to a thickness ($t_2$) as best seen in FIG. 8 where the dashed lines show the initial dimensions and the solid lines show the final or desired dimensions. The thickness ($t_2$) is now approximately 0.5 mm +0.2 mm which is less than ($t_1$), about one-third less. Depending upon the given application for the valve, the initial diameter ($d_1$) of the valve head 22 and initial thickness ($t_1$) of the valve seat interface 56 are selectively provided based upon valve material, seat facing material, and temperature to allow for PTA seat facing without burn-through. Then, coin step 40 provides the final or desired diameter ($d_2$) of the valve head 22 and the thickness ($t_2$) of the valve seat interface 56.

Figure 6:
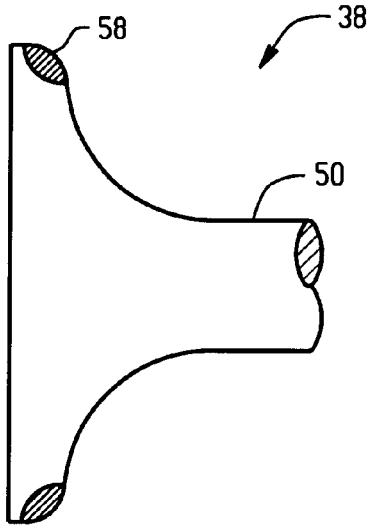

FIG. 7 depicts the completed or finished engine poppet valve with a forged cup 60 on the face 18 of the valve 10. A convex shape of the seat facing material 58 as seen in FIG. 6 is hot formed during the coin step 40 into the seat interface 56 of the valve head 22. Advantageously, the process 30 of the present invention allows for forging a snag during the coin step 40. The term "snag" refers to a surface layer on the interface 56 which is removed by machining. Rather than machine the snag, the process of the present invention simply coins the snag during the coin step 40.

The coining operation of the coin step 40 in the present invention flattens the convex seat facing material 58, reduces the seat face interface 56 with the combustion face 18, and leaves a forged finish on the combustion face 18 and fillet 14 of the poppet valve 10. As is known in this art, coining temperatures vary depending upon the types of material used. The coining temperature preferably employed herein is approximately 1100° C.

In the above manner, the process 30 of the present invention, particularly in the coin step 40, decreases the thickness of the valve seat from ($t_1$) to ($t_2$), and increases the diameter of the valve head 22 from ($d_1$) to ($d_2$). In this fashion, there is no additional stock material added to the combustion face to allow for PTA seat facing without burn-through, and no requirement for any machining with the process 30 of the present invention.

The improved process of the present invention provides the following advantages over conventional methods. Less seat facing material is used while the same seat facing material depth is maintained. There is less base material dilution of the seat facing alloy that occurs adjacent the valve seat interface simply because virtually no seat facing alloy is being machined away. Less seat facing material must be machined or ground from the seat face. Coining virtually eliminates any internal porosity created by the welding process Additionally, the improved process eliminates the need for removing excess material required to PTA weld a thin faced valve. For austentic exhaust valves made with the present invention, the base material microstructure has grain shapes that have changed from the uniaxial to elongated shape along the bondline direction due to the hot forge operation.

Depending upon the given application, the poppet valve may be solution heat treated and age hardened in the optional heat treatment step 42 prior to or after forge. Suitable heat treatment processes are well known in the industry and to those skilled in this art.

While specific embodiments of the invention have been shown and described in detail to illustrate the application of the principles of the invention, it will be understood that the invention may be embodied otherwise without departing from such principles.

We claim:

1. A method (30) for making an engine poppet valve (10) having a desired head diameter ($d_2$), comprising the steps of:

forging (34) an unfinished poppet valve (50) from stock material (44) to provide a valve head (22) having an initial head diameter ($d_1$);

forming (36) a seat facing groove (54) in the valve head (22) of the unfinished poppet valve (50);

providing an initial thickness ($t_1$) of an interface (56) of the seat facing groove (54) and a combustion face (18) of the unfinished poppet valve (50);

depositing (38) seat facing material (58) in the seat facing groove (54); and reheating (40) the valve head (22) and coining (40) a desired head diameter ($d_2$) while hot forming the seat facing material (58) into the interface (56) to decrease the interface (56) from the initial thickness ($t_1$) to a final thickness ($t_2$) and increase the valve head diameter (22) from the initial diameter ($d_1$) to a desired diameter ($d_2$) for finishing the engine poppet valve (10).

2. A method according to claim 1, wherein the depositing step (38) comprises the step of welding with a plasma transferred arc.

3. A method according to claim 1, wherein the engine poppet valve (40) is an engine exhaust valve.

4. A method according to claim 3, wherein the step of forging (34) an unfinished poppet valve (50) further comprises the steps of upsetting and forging (34) a pin (46) into the unfinished engine poppet valve (50).

5. In a process (30) for making a poppet valve (10) having a desired diameter ($d_2$) of a valve head (22) with a selected thickness ($t_2$) of an interface (56) of a seat facing groove (54) and a combustion face (18), the process including the step (38) of placing seat facing material (58) in the seat facing groove (54) of the poppet valve (10), the improvement comprises the steps of:

providing (36) an unfinished engine poppet valve (50) with an initial diameter ($d_1$) of a valve head (22) and an initial thickness ($t_1$) of an interface (56) prior to the seat facing step (38) to prevent burn-through during the seat facing step; and reheating and coining (40) the valve head (22) after seat facing (38) to decrease the interface (56) from the initial thickness ($t_1$) to a selected thickness ($t_2$) and increase the diameter of the valve head (22) from the initial diameter ($d_1$) to a desired diameter ($d_2$) to forge finish the engine poppet valve (10).

6. The process as recited in claim 5, wherein the reheating and coining step (40) includes the step of hot forming the seat facing material (58) of the unfinished poppet valve (50) for flattening a convex shape of the seat facing material (58) and providing a forged finish.

7. The process as recited in claim 5, wherein the seat facing step (38) comprises the step of welding with a plasma transferred arc process.

* * * * *